United States Patent [19]

Kuttner

[11] 4,178,000

[45] Dec. 11, 1979

[54] SEALING PROVIDED BETWEEN THE WALLS OF A COOLED CONTINUOUS MOULD AND THE HEAD OF A STARTER BAR

[75] Inventor: Gottfried Kuttner, Linz, Austria

[73] Assignee: Vereinigte Österreichische Eisen- und Stahlwerke - Alpine Montan Aktiengesellschaft, Linz, Austria

[21] Appl. No.: 884,001

[22] Filed: Mar. 6, 1978

[30] Foreign Application Priority Data

Mar. 25, 1977 [AT] Austria ..... 2099/77

[51] Int. Cl.[2] ..... B22D 11/08; F16J 15/18

[52] U.S. Cl. ..... 277/138; 277/226; 277/DIG. 6; 164/425; 164/445

[58] Field of Search ..... 164/425, 426, 445, 446; 277/DIG. 6, 138, 165, 226, 96, 96.1, 96.2

[56] References Cited

U.S. PATENT DOCUMENTS

| | | | |
|---|---|---|---|
| 2,774,621 | 12/1956 | Kilbourne | 277/DIG. 6 |
| 2,838,328 | 6/1958 | Rohrberg | 277/226 X |
| 3,000,846 | 9/1961 | Runton et al. | 277/96.2 X |
| 3,080,625 | 3/1963 | Pearson et al. | 164/425 |
| 3,093,383 | 6/1963 | Lew | 277/96 X |
| 3,455,565 | 7/1969 | Jepsen | 277/138 |
| 3,512,790 | 5/1970 | Marcel | 277/96.2 X |
| 3,593,777 | 7/1971 | Pietryka | 164/445 |
| 3,795,270 | 3/1974 | Fiala et al. | 164/425 X |
| 3,799,238 | 3/1974 | Bruderer et al. | 164/82 |
| 4,098,515 | 7/1978 | Sakata | 277/96.2 X |

FOREIGN PATENT DOCUMENTS

| | | | |
|---|---|---|---|
| 978719 | 12/1975 | Canada | 164/426 |
| 704512 | 4/1941 | Fed. Rep. of Germany | 164/445 |
| 170047 | 10/1921 | United Kingdom | 277/226 |
| 506254 | 5/1939 | United Kingdom | 277/165 |
| 668356 | 3/1952 | United Kingdom | 277/165 |
| 1141049 | 1/1969 | United Kingdom | 277/96.2 |

*Primary Examiner*—Robert S. Ward, Jr.
*Attorney, Agent, or Firm*—Brumbaugh, Graves, Donohue & Raymond

[57] ABSTRACT

In a continuous casting plant the space between the walls of a cooled continuous casting mould and the head of a starter bar is sealed. The seal is achieved by means of an elastic member inserted in an annular peripheral recess of the starter bar head. The elastic member closes the recess, extends completely around the starter bar head in the groove and may have a cylindrical or plane shape.

31 Claims, 5 Drawing Figures

SEALING PROVIDED BETWEEN THE WALLS OF A COOLED CONTINUOUS MOULD AND THE HEAD OF A STARTER BAR

BACKGROUND OF THE INVENTION

The invention relates to a seal to be applied between the walls of a cooled continuous mould and the head of a starter bar in a continuous casting plant.

It has been known to seal off the starter bar head positioned in the mould with respect to the mould walls by means of sealing cords, such as asbestos cords. The sealing cords have to be introduced by hand and pressed with great care in between the starter bar head and the mould walls. This operation has to be carried out anew with each casting start, thus long set-up times are necessary. Therefore, it may happen that a subsequent charge cannot be poured in time. A further disadvantage of this seal is that its quality depends on the care and skill of the worker attaching the sealing. If the worker fails to notice a leakage, a running out of the molten metal at the onset of casting will result. Furthermore, it is disadvantageous that the sealing cords are deposited in the strand guide after extraction of the starter bar head, thus necessitating additional cleaning.

SUMMARY OF THE INVENTION

The invention aims at avoiding these disadvantages and difficulties and has as its object to create a seal which, independent of manipulations to be carried out manually, can be relied on to be always tight, which can be used several times, and which can be made tight within a minimum of time. In particular, manipulations at the seal should not be necessary any longer, once the starter bar head is in the mould. Furthermore, dirt accumulations on the strand guide caused by the seal are to be prevented.

These objects are achieved according to the invention in that the starter bar head comprises a ring-shaped peripheral recess, into which an elastic seal is inserted.

According to a preferred embodiment a hose-shaped seal is inserted into the annular recess and, preferably, a gaseous medium is introduced into the seal for widening the space within the hose.

In this case, the ring-shaped recess is suitably covered with a flexible membrane.

The seal advantageously is made up of textile material, preferably asbestos textile fabrics, which textile material may be impregnated or coated with temperature-resistant synthetic material, such as polytetrafluorethylene or silicone-caoutchouc.

It is advantageous if the starter bar head is cross-dividedly designed with the upper part, i.e. the sealing head, being provided with the annular peripheral recess, and the seal being inserted therein and, if desired, fixed with an adhesive thus leading to a further saving of time when introducing the starter bar head into the mould.

According to a further advantageous embodiment the seal is reinforced with an annular leaf spring.

BRIEF DESCRIPTION OF THE DRAWINGS

The invention is explained in more detail by way of several embodiments and with reference to the accompanying drawings, wherein.

DESCRIPTION OF ILLUSTRATIVE EMBODIMENTS

Figure 1:
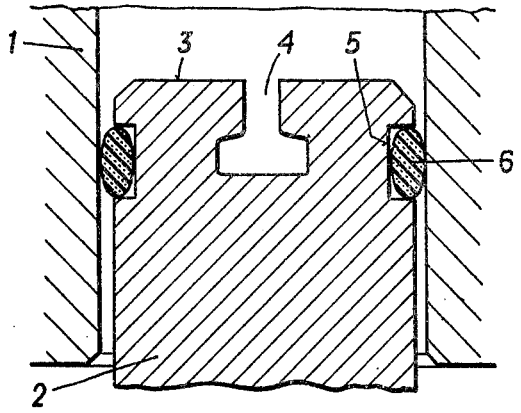
FIG. 1 shows an axially sectioned starter bar head having an elastic seal with a solid cross section located in a peripheral groove of the starter bar.

The lower end of a continuous mould illustrated in axial section is denoted by 1, into which mould end a starter bar head 2 of a starter bar is inserted from below or from above. The starter bar head is detachably connected with the starter bar in a known way. The starter bar head, on its front side 3 has a T-shaped groove 4, into which a cast-on piece (not illustrated) with a rail-shaped profile can be inserted from the side. The cast-on piece, on the part projecting into the mould, is surrounded by molten steel at the start of casting, thus forming a connection between the starter bar head and the strand. By laterally drawing the cast-on piece out of the groove 4 the starter bar head can easily be separated from the initial part of the strand.

According to the invention the starter bar head includes a peripheral recess 5 arranged just below the front side 3 and extending parallel to the front side so as to annularly surround the starter bar head. Into this peripheral, groove-shaped recess, a seal 6, made up of elastic material, is inserted. According to FIG. 1, the seal has a full, oval cross section. The seal can be inserted into the groove-like recess 5 when the starter bar head is made ready outside the mould for the next casting start. When the starter bar head is inserted in the mould — as illustrated in FIG. 1 — a liquid-proof contact will be created between the seal and the mould walls, by elastically pressing together the part of the seal projecting beyond the starter bar head between the mould walls and the bottom of the recess 5.

After applying cover chips as usual, casting can be started at once, no manipulations being necessary at the seal itself.

Figure 2:
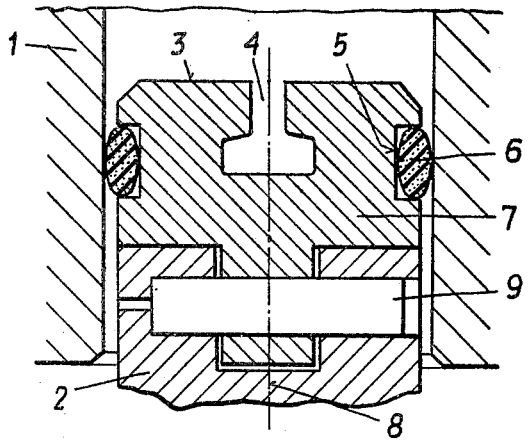
FIG. 2 is like FIG. 1, except that the starter bar is in two parts.

Like FIG. 1, FIG. 2 shows a seal 6, which, however, is arranged on a special sealing head 7 that is separated from the starter bar head transverse to the longitudinal axis 8 of the starter bar head. By means of a transverse bolt 9, the sealing head is detachably fastened to the starter bar head. This embodiment has the advantage that only several of the sealing heads 7 have to be stored for different size castings, not entire starter bar heads. Exchanging the sealing head 7 is effected in a simpler and quicker way than exchanging the whole starter bar head, which results in a saving of time whenever exchange of the sealing head is desired.

Figure 3:
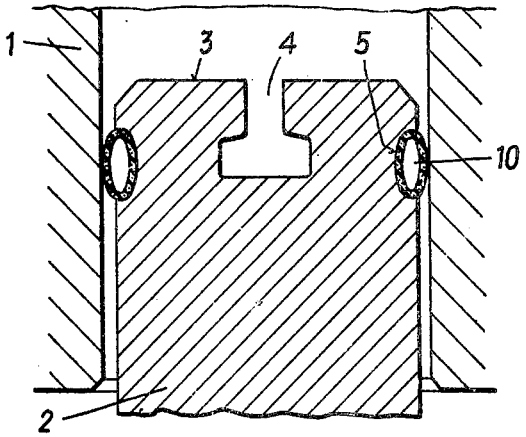
FIG. 3 is an embodiment like FIG. 1 in which the seal is hose-shaped.

FIG. 3 shows a hollow, hose-shaped seal 10 fastened to the peripheral recess 5 of the starter bar head by an adhesive. When the starter bar head is inserted into the mould, the space within the seal is pressed together and the gaseous medium therein exerts pressure against the mould walls to the extent necessary for sealing off the mould.

Figure 4:
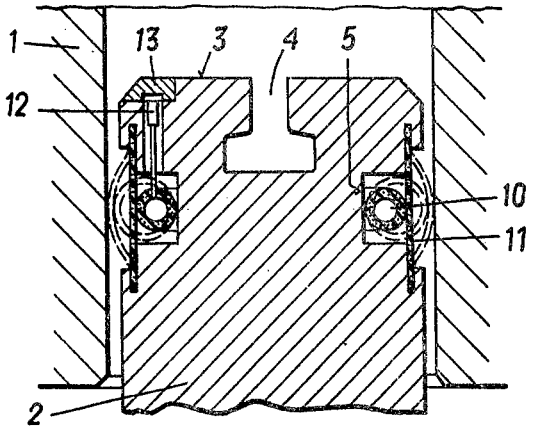
FIG. 4 is an embodiment like that in FIG. 3, except the hose-shaped seal is inflatable and is covered by a membrane.

In FIG. 4 a hose-shaped seal 10 incorporated in the starter bar head is covered, outwardly towards the mould walls, with a flexible membrane 11. Through a valve 12 a pressure medium, such as air, can be entered into the space within the hose-shaped seal, so that the flexible membrane is pressed against the mould walls when the hose-shaped seal expands, as is shown in FIG. 4 by the broken lines. A cover plate 13 serves for protecting the valve against dirt accumulation caused by the cover chips.

Figure 5:
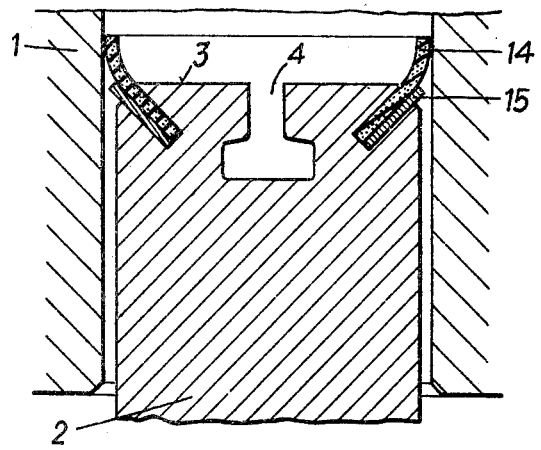
FIG. 5 is an embodiment wherein the seal is in the form of an elastic plate reinforced by a leaf spring.

A further embodiment is represented in FIG. 5. There the peripheral recess is designed as a slot arranged at an incline towards the front face 3, in which slot a flat seal, such as an elastically deformable sealing plate 14, is inserted. According to FIG. 5 a metallic leaf spring 15 for supporting the sealing plate against pressure from above is provided for reinforcing this sealing plate, which spring-leaf, like the sealing plate 14, extends annularly about the starter bar head.

The invention shall not be limited to the embodiments explained in the description of the Figures, but can be modified in various aspects. The seal according to the invention can also be provided for tong-shaped starter bar heads. Utilization of the invention with one-way starter bar heads is also possible, the elastic seal advantageously being loosely arranged in the peripheral recess, thus being usable several times.

What I claim is:

1. A sealing arrangement to be used in a continuous casting plant of the type including a cooled continuous mould, said cooled continuous mould having walls and accommodating a starter bar having a starter bar head, said sealing arrangement being provided between said walls of said cooled continuous mould and said starter bar head, wherein the improvement is characterized in that said sealing arrangement comprises an elastic seal, said starter bar head having an annular peripheral recess, said elastic seal being inserted in said annular peripheral recess and being dimensioned so as to close off said recess, said seal also extending completely about the starter bar head periphery.

2. A sealing arrangement as set forth in claim 1, wherein said elastic seal is a hose-shaped seal.

3. A sealing arrangement as set forth in claim 2, wherein said hose-shaped sealing has a space within said hose-shaped sealing, a gaseous medium being introduceable into said hose-shaped sealing for expansion of said space within said hose-shaped sealing.

4. A sealing arrangement as set forth in claim 3, further comprising a flexible membrane for covering said annular peripheral recess.

5. A sealing arrangement as set forth in claim 1, wherein said seal is made up of textile material, said textile material being treated with temperature-resistant synthetic material.

6. A sealing arrangement as set forth in claim 5, wherein said temperature-resistant synthetic material is polytetrafluorethylene.

7. A sealing arrangement as set forth in claim 5, wherein said temperature-resistant synthetic material is silicone caoutchouc.

8. A sealing arrangement as set forth in claim 5, wherein said textile material is impregnated with said temperature-resistant synthetic material.

9. A sealing arrangement as set forth in claim 5, wherein said textile material is coated with said temperature-resistant synthetic material.

10. A sealing arrangement as set forth in claim 5, wherein said textile material is an asbestos textile fabric.

11. A sealing arrangement as set forth in claim 4, wherein said sealing is made up of textile material, said textile material being treated with temperature-resistant synthetic material.

12. A sealing arrangement as set forth in claim 11, wherein said temperature-resistant synthetic material is polytetrafluorethylene.

13. A sealing arrangement as set forth in claim 11, wherein said temperature-resistant synthetic material is silicone caoutchouc.

14. A sealing arrangement as set forth in claim 11, wherein said textile material is impregnated with said temperature-resistant synthetic material.

15. A sealing arrangement as set forth in claim 11, wherein said textile material is coated with said temperature-resistant synthetic material.

16. A sealing arrangement as set forth in claim 11, wherein said textile material is an asbestos textile fabric.

17. A sealing arrangement as set forth in claim 4, wherein said sealing and said membrane are made up of textile material, said textile material being treated with temperature-resistant synthetic material.

18. A sealing arrangement as set forth in claim 17, wherein said temperature-resistant synthetic material is polytetrafluorethylene.

19. A sealing arrangement as set forth in claim 17, wherein said temperature-resistant synthetic material is silicone caoutchouc.

20. A sealing arrangement as set forth in claim 17, wherein said textile material is impregnated with said temperature-resistant synthetic material.

21. A sealing arrangement as set forth in claim 17, wherein said textile material is coated with said temperature-resistant synthetic material.

22. A sealing arrangement as set forth in claim 17, wherein said textile material is an asbestos textile fabric.

23. A sealing arrangement as set forth in claim 4, wherein said membrane is made up of textile material, said textile material being treated with temperature-resistant synthetic material.

24. A sealing arrangement as set forth in claim 23, wherein said temperature-resistant synthetic material is polytetrafluorethylene.

25. A sealing arrangement as set forth in claim 23, wherein said temperature-resistant synthetic material is silicone caoutchouc.

26. A sealing arrangement as set forth in claim 23, wherein said textile material is impregnated with said temperature-resistant synthetic material.

27. A sealing arrangement as set forth in claim 23, wherein said textile material is coated with said temperature-resistant synthetic material.

28. A sealing arrangement as set forth in claim 23, wherein said textile material is an asbestos textile fabric.

29. A sealing arrangement as set forth in claim 1, wherein said starter bar head is cross-dividedly designed so as to have an upper part and a lower part, said upper part forming a sealing head and being provided with said annular peripheral recess and said sealing inserted therein.

30. A sealing arrangement as set forth in claim 29, wherein said sealing inserted in said annular peripheral recess is fixed therein with an adhesive.

31. A sealing arrangement as set forth in claim 1, further comprising an annular spring-leaf for reinforcing said sealing.

* * * * *